US005299368A

United States Patent [19]

Liu

[11] Patent Number: 5,299,368

[45] Date of Patent: Apr. 5, 1994

[54] SHOE MIDSOLE WITH VENTILATION DEVICES

[76] Inventor: Su-Man H. Liu, 7F-4, No. 18, Lane 19, Sec. 1, Shuang Shyr Rd., Taichung, Taiwan

[21] Appl. No.: 111,866

[22] Filed: Aug. 26, 1993

[51] Int. Cl.[5] ..... A43B 7/06

[52] U.S. Cl. ..... 36/3 B; 36/3 R

[58] Field of Search ..... 36/3 A, 3 B, 3 R, 28, 36/29, 35 R, 35 B, 88, 92, 132, 136, 37

[56] References Cited

U.S. PATENT DOCUMENTS

| | | | |
|---|---|---|---|
| 1,660,698 | 2/1928 | Williams, Sr. | 36/3 R |
| 1,938,393 | 12/1933 | Kelley | 36/3 R |
| 2,003,646 | 6/1935 | De Blasio | 36/3 R |
| 2,050,337 | 8/1936 | Kelley | 36/3 R |
| 2,751,692 | 6/1956 | Cortina | 36/3 B |
| 5,068,981 | 12/1991 | Jung | 36/3 B |

*Primary Examiner*—Paul T. Sewell
*Assistant Examiner*—Thomas P. Hilliard
*Attorney, Agent, or Firm*—Browdy and Neimark

[57] ABSTRACT

A shoe midsole has a heel portion provided with an elastic shock-absorbing member which is embedded therein and which has an arcuate projection, an air chamber, a plurality of cavities located in the peripheries of the arcuate projection, a plurality of first air ducts through which the cavities communicate with the air chamber, and a plurality of through holes extending from the top surface of the arcuate projection to communicate with the air chamber. The elastic shock-absorbing member further has a plurality of second air ducts extending inwards along the peripheries thereof to communicate with the cavities. The heel portion is provided with a plurality of recesses corresponding in location and number to the second air ducts.

6 Claims, 3 Drawing Sheets

SHOE MIDSOLE WITH VENTILATION DEVICES

FIELD OF THE INVENTION

The present invention relates generally to a shoe, and more particularly to a shoe midsole having shock-absorbing and breathing effects.

BACKGROUND OF THE INVENTION

In an attempt to capture a lion's share of the shoe market, some ambitious shoe makers have made an effort to improve the quality of wearing comfort of the shoes they make. For example, some shoes are provided in the heel portion thereof with a highly elastic pad for enhancing the elasticity of the shoes. However, such shoes have a poor breathing effect. In order to improve the breathing effect of the shoes, some shoe makers have come up with a solution that the insole of a shoe is provided thereon with a breathable shoe pad. Nevertheless, such shoe pad is in fact capable of providing only a very limited breathing effect, because the shoe in itself is not provided with an air-circulating means.

SUMMARY OF THE INVENTION

It is therefore the primary objective of the present invention to provide a shoe midsole capable of causing the air inside and outside the shoe to circulate.

It is another objective of the present invention to provide a shoe midsole having an excellent shock-absorbing effect.

The foregoing objectives of the present invention are attained by a shoe midsole, which comprises a sole portion, a heel portion, a shank connecting the sole portion and the heel portion, and an elastic shock absorbing member disposed in the heel portion. The elastic shock absorbing member has an arcuate projection and an air chamber located at the lower end of the arcuate projection. Located in the surface of the arcuate projection are a plurality of cavities, each of which has an open end that is situated in the top of the elastic shock absorbing member. Each of the cavities is in communication with the air chamber through a first air duct. The arcuate projection is provided with a plurality of first through holes through which the air chamber is in communication with the outside of the shoe midsole. The heel portion is provided on the top thereof with a plurality of second through holes corresponding in location to the cavities. As the heel portion of the shoe midsole is exerted on by the treading pressure of a person's heel, the air inside the shoe is caused to circulate by the air chamber in cooperation with the arcuate projection. In addition, the heel portion of the shoe midsole has a shock-absorbing effect.

DETAILED DESCRIPTION OF THE INVENTION

Figure 1:
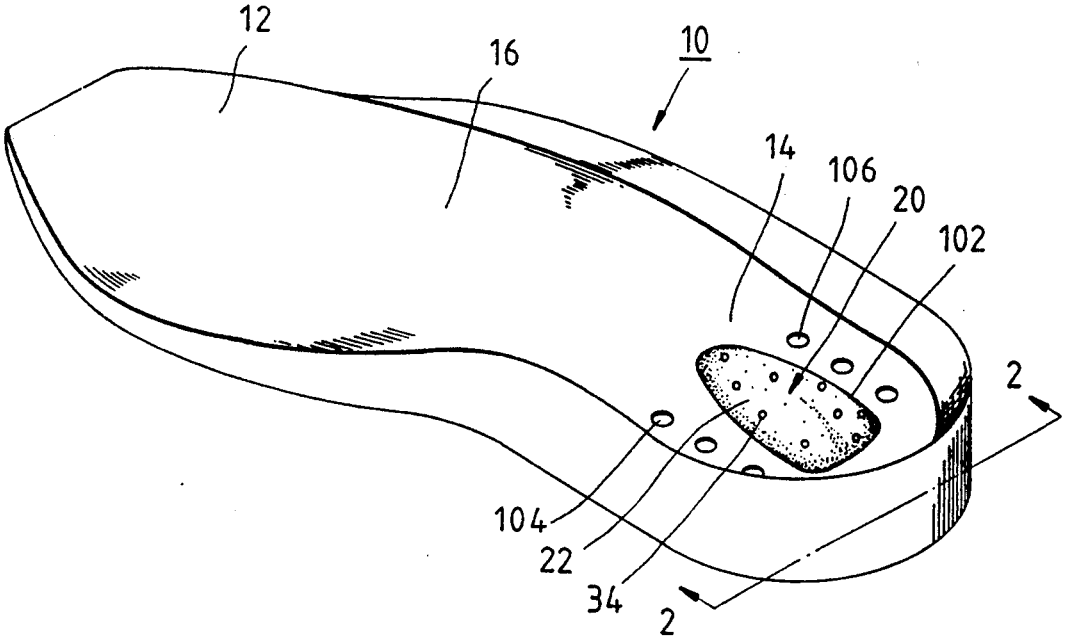
FIG. 1 shows a perspective view of a first preferred embodiment of the present invention.
Figure 2:
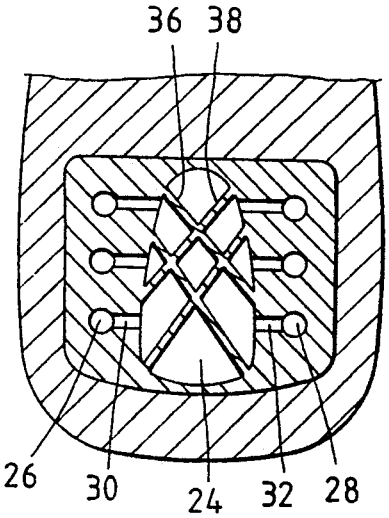
FIG. 2 shows a sectional view of a portion taken along the line 2—2 as shown in FIG. 1.

Referring to FIGS. 1-4, a shoe midsole 10 of EVA (ethylene vinyl acetate) of the first preferred embodiment of the present invention is shown to comprise a sole portion 12, a heel portion 14, and a shank portion 16 connecting the sole portion 12 and the heel portion 14. The midsole 10 has a thickness that is progressively thicker from the sole portion 12 toward the heel portion 14.

The heel portion 14 is provided with an elastic shock-absorbing member 20 which is made of an elastic polymer and is embedded in the heel portion 14. The elastic shock-absorbing member 20 is provided integrally with an arcuate projection 22, an air chamber 24, and two sets of cavities 26 and 28. In the first preferred embodiment of the present invention, each of the two cavity sets comprises three cavities. Each of the cavities 26 & 28 has an open end situated in a top surface 202 of the shock-absorbing member 20. The air chamber 24 is in communication with the cavities 26 and 28 via first air ducts 30 and 32. The arcuate projection 22 is provided in the top surface thereof with a plurality of first through holes 34 communicating the air chamber 24 with the outside of the midsole 10. The air chamber 22 is provided therein with two sets of reinforcing ribs 36 and 38, each of which has an upper end that is connected with the bottom of the arcuate projection 22, and each of which has two sides that are respectively connected with two side walls of the air chamber 24. Each of the reinforcing ribs 36 and 38 has a height that is smaller than the greatest height of the air chamber 24. The reinforcing ribs 36 and 38 are provided respectively with arcuate recessed edges 362 and 382. The reinforcing ribs of the same set are parallel to each other while the reinforcing ribs of the different sets are normal to each other. As a result, each of the reinforcing ribs 36 and 38 forms an arched space in conjunction with the outsole, thereby enabling the arcuate projection 22 to bounce back up after being exerted on by a pressure.

The elastic shock-absorbing member 20 is preformed. In the process of making the shoe midsole 10 of the present invention, the elastic shock-absorbing member 20 is disposed in a molding tool forming the midsole 10 such that the elastic shock-absorbing member 20 is corresponding in location to the heel portion 14. The midsole 10 is provided in the top surface thereof with an opening 102 intended for the arcuate projection 22 to emerge therefrom, and with two second through holes 104 and 106 for communicating with the cavities 26 and 28.

Figure 3:
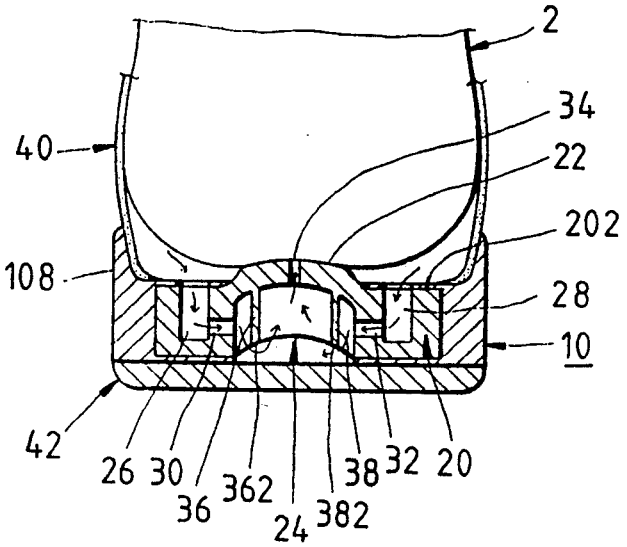
FIGS. 3 and 4 are cross-sectional views showing the first preferred embodiment of the present invention as the part of a shoe, with FIG. 3 showing that the heel portion of the midsole of the present invention is not exerted on by a pressure, and with FIG. 4 showing that the heel portion of the midsole of the present invention is exerted on by a pressure.
Figure 4:
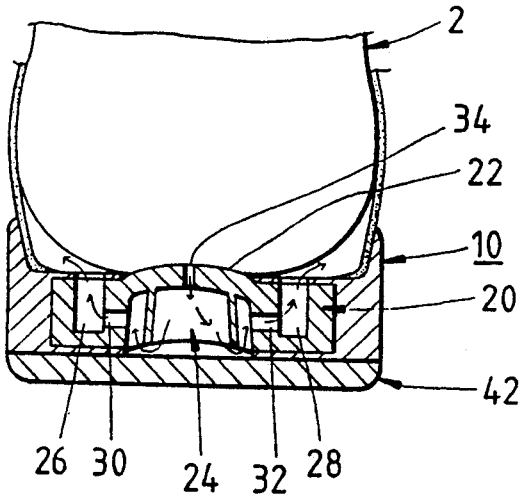

The shoe midsole 10 of the present invention is provided on the top surface thereof with a protruded edge 108 that is adhered to the shoe 40. The bottom surface of the shoe midsole 10 of the present invention is adhered to the shoe outsole 42. The treading action of a heel 2 brings about a pumping effect by the arcuate projection 22 and the air chamber 24 of the shock-absorbing 20, as illustrated in FIG. 3. As the arcuate projection 22 is caused to bounce back up to its original position, a suction is generated so as to cause the air to enter from the cavities 26 and 28 into the air chamber 24 via the first air ducts 30 and 32. The air which has entered the air chamber 24 is then expelled through the first through holes 34. On the other hand, when the arcuate projection 22 is exerted on by a pressure, a force which is opposite to the suction mentioned previously is so generated as to cause the air to enter from the first through holes 34 into the air chamber 24 from which the air is then expelled from the cavities 26 and 28 via the first air ducts 30 and 32, as shown in FIG. 4. The midsole 10 of the present invention is provided with a pumping effect capable of bringing about the air circulation as well as the shock absorption.

It must be noted here that the pumping effect of the midsole 10 of the present invention is further enhanced by means of the arcuate recessed edges 362 and 382 of the reinforcing ribs 36 and 38, which enable the arcuate projection 22 to bounce back up immediately after the arcuate projection 22 is pressed downwards.

Figure 5:
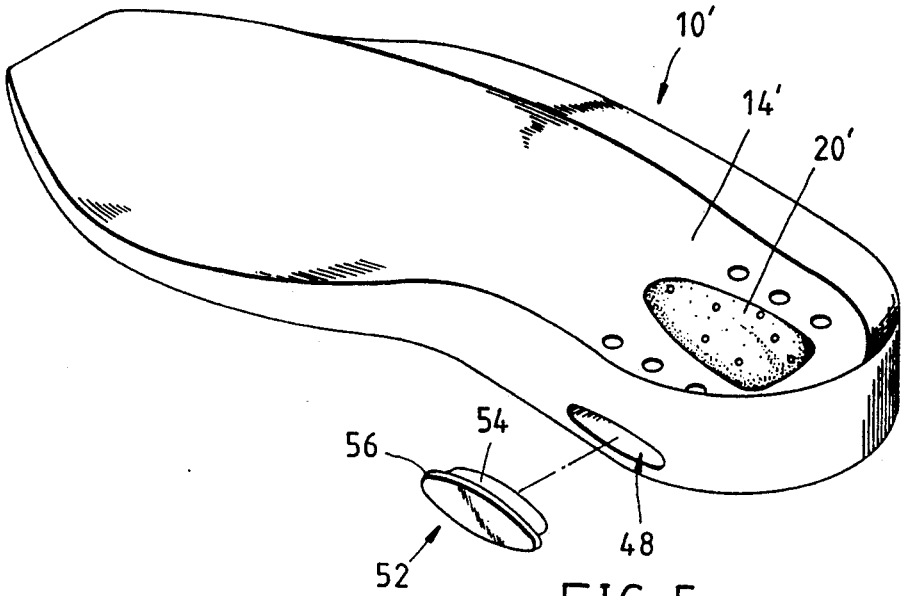
FIG. 5 shows a perspective view of a second preferred embodiment of the present invention.
Figure 6:
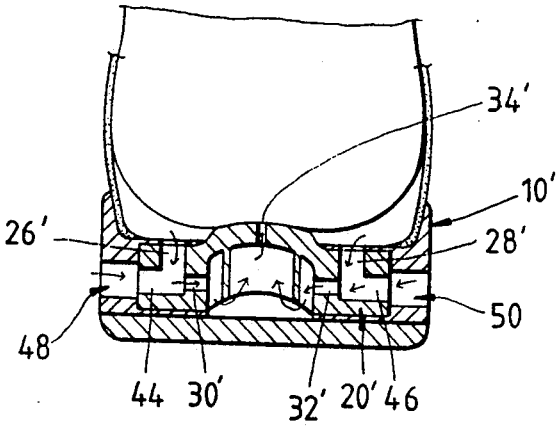
FIGS. 6 and 7 are cross-sectional views showing the second preferred embodiment of the present invention as the part of a show, with FIG. 6 showing that the heel portion of the midsole of the present invention is not exerted on by a pressure, and with FIG. 7 showing that the heel portion of the midsole of the present invention is exerted on by a pressure.
Figure 7:
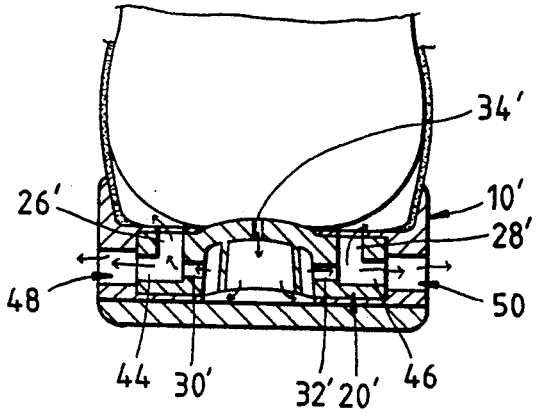

The second preferred embodiment of the present invention is illustrated in FIGS. 5–7. A midsole 10′ of the second preferred embodiment of the present invention is different from the midsole 10 of the first preferred embodiment of the present invention in that the former has the elastic shock-absorbing member 20′ provided peripherally with second air ducts 44 and 46 corresponding in location to and communicating with cavities 26′ and 28′, and that the former is provided with a heel portion 14′ having oval recesses 48 and 50 which are in communication with the second air ducts 44 and 46 respectively. When the pumping effect of the shock-absorbing member 20′ is brought about, the air circulation takes place in shorter routes, as indicated by arrows in FIGS. 6 and 7.

The midsole of the present invention is so designed that it can be adapted to an indoor shoe or an outdoor shoe. As shown in FIG. 5, the midsole 10′ of the present invention is provided with a plastic stopper 52 having a flange 56 and an insertion portion 54 dimensioned to fit into the oval recesses 48 and 50 for preventing the rain water from entering the shoe midsole 10′ via the oval recesses 48 and 50.

What is claimed is:

1. A shoe midsole comprising a sole portion, a heel portion, a shank portion connecting said sole portion and said heel portion, and an elastic shock-absorbing member embedded in said heel portion; wherein said elastic shock-absorbing member has an arcuate projection, an air chamber, a plurality of cavities having an open end situated in a top surface of said elastic shock-absorbing member, a plurality of first air ducts through which said cavities are in communication with said air chamber, and a plurality of first through holes extending from a top surface of said arcuate projection to communicate with said air chamber; and wherein said heel portion is provided in a top surface thereof with an opening corresponding in location to said arcuate projection, and with a plurality of second through holes corresponding in location to said cavities.

2. The shoe midsole of claim 1 wherein said arcuate projection is provided in a bottom thereof with a plurality of reinforcing ribs, each of which has a height smaller than a maximum height of said air chamber.

3. The shoe midsole of claim 2 wherein each of said reinforcing ribs has a lower recessed edge of arcuate construction.

4. The shoe midsole of claim 2 wherein said reinforcing ribs are grouped into two sets, with said reinforcing ribs of the same set being parallel to one another, and with said reinforcing ribs of the different set being perpendicular to one another.

5. The shoe midsole of claim 1 wherein said elastic shock-absorbing member is further provided with a plurality of second air ducts which extend along peripheries of said elastic shock-absorbing member to communicate with said cavities; and wherein said heel portion is provided in lateral sides thereof with a plurality of recesses corresponding in location and number to said second air ducts.

6. The shoe midsole of claim 5 further comprising a plurality of stoppers dimensioned to fit into said recesses.

* * * * *